United States Patent [19]

Wilkins

[11] Patent Number: 4,637,612

[45] Date of Patent: Jan. 20, 1987

[54] GOLF CLUB SWING TRAINING AID

[76] Inventor: Judd Wilkins, 281 Littletown Quarter, Williamsburg, Va. 23185

[21] Appl. No.: 758,946

[22] Filed: Jul. 25, 1985

[51] Int. Cl.[4] ..... A63B 69/36

[52] U.S. Cl. ..... 273/183 B; 2/246; 2/69; 40/1.5; 273/DIG. 30

[58] Field of Search ..... 273/183 B, DIG. 30; 2/246, 244, 279, 69; 40/1.5

[56] References Cited

U.S. PATENT DOCUMENTS 3,643,960 2/1972 Gentilly ..... 273/183 B 4,392,830 7/1983 Salzman et al. ..... 434/252

*Primary Examiner*—George J. Marlo

*Attorney, Agent, or Firm*—Griffin, Branigan, & Butler

[57] ABSTRACT

A club-swing marker assembly includes a flat base member (18) permanently affixed to the front shoulder area (16) of a shirt (12) and covering a relatively large area thereof but having a fastening means (29) thereon for cooperating with a releasable fastener means (40) of a marker member (20) which can be easily and repetitively moved about on the base member (18). The fastening means is a hook/loop fastener pair. A marker element (36) on the marker member (20) contacts the chin area of a sportsman at a predetermined point during a swing of a club thereby providing a distinctive sensation which indicates to the sportsman that such contact has been made so that the sportsman will be aware that a correct club-swing position has been achieved. The marker element is constructed of a humped hook-fastening member to form an indicating ridge having fastening hooks thereon for contacting the sportsman's chin.

3 Claims, 3 Drawing Figures

FIG. 1
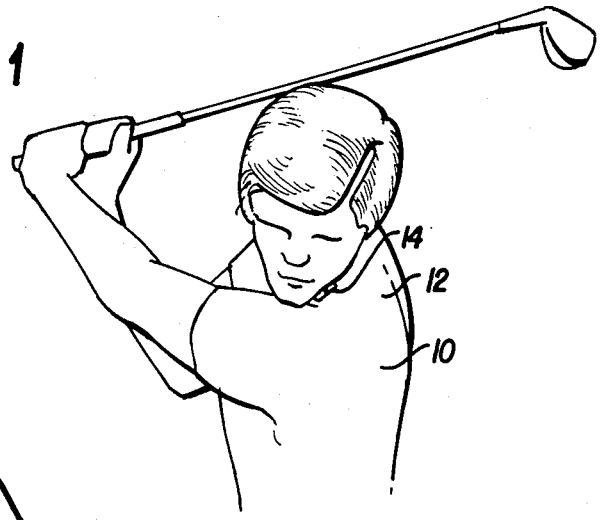
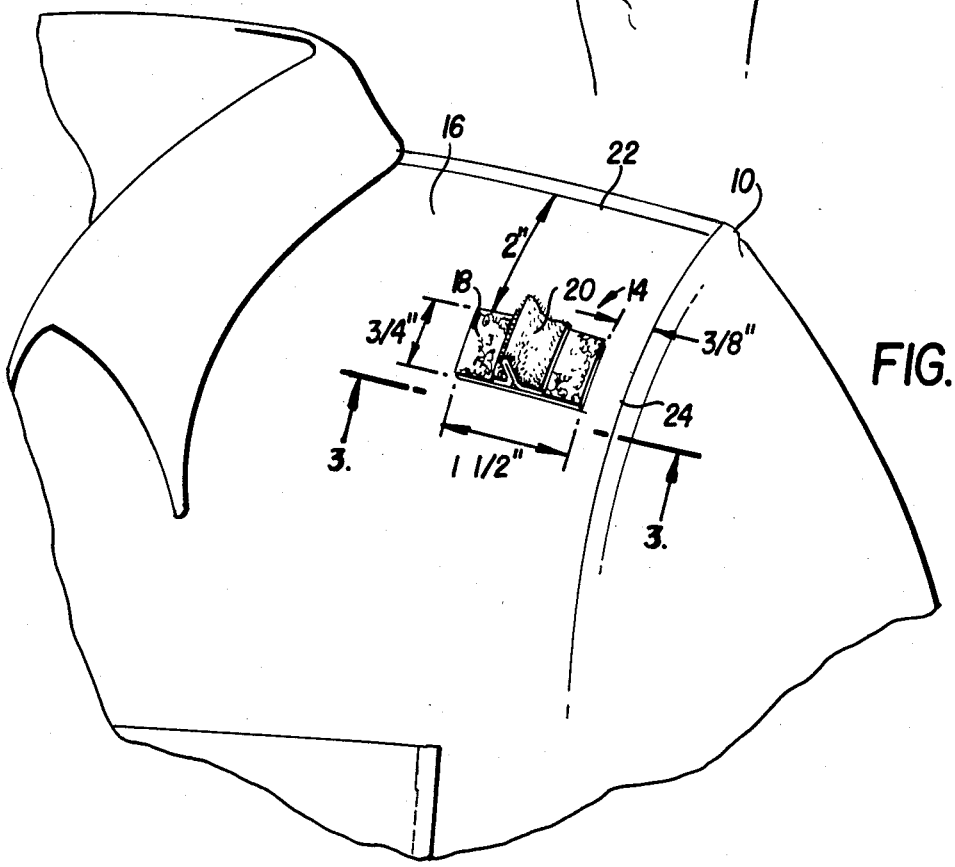
FIG. 2
FIG. 3
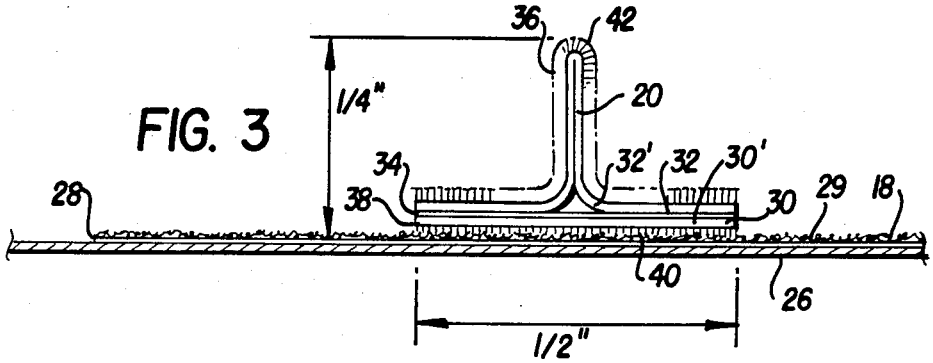

GOLF CLUB SWING TRAINING AID

BACKGROUND OF THE INVENTION

This invention relates generally to the art of sports devices, and more particularly, to a mechanism which is for improving a club swing of a sports club, such as a golf club.

Several devices have been suggested in the past for use in helping to teach sportsmen proper body positions for swinging clubs, such as golf clubs. For example, U.S. Pat. No. 3,643,960 to Gentilly describes a training device adapted to teach a golfer to keep his head down during swings and also to complete back and forward swings. In the device of this patent a whistle is strapped to the golfer's shoulder and is activated when the golfer's face comes in contact with the whistle, thus indicating that the golfer's head remained in the correct position during a back swing or a forward swing, depending on where it is located. U.S. Pat. No. 4,392,830 describes a body coordination training aid in which a sportsmen wears a head band having an audio generator and a head electrode attached thereto with shoulder electrodes mounted on the sportsman's shoulders. Contact between the shoulder electrodes and the head mounted electrode causes the audio generator to make a noise indicating to the sportsman that certain body positions have been reached. Problems with both of these teachings are not only that the devices are rather complicated in nature but that they cause sportsmen wearing them to unduly, visually, "stand out". Thus, it is an object of this invention, to provide a training aid which indicates to a sportsman when a proper body position has been achieved during a club swing which is uncomplicated in nature and which is not unduly noticeable by others.

Yet another difficulty with the above-described prior art suggestions is that these training devices are relatively time-consuming and difficult to use in that they are difficult to adjust to fit various body shapes and sizes. Further, it is difficult to adjust such devices for a golfer who, for example, wishes to make changes to his swing. Thus, it is an object of this invention to provide a club-swing body position device which allows easy adjustment thereof for various body shape and sizes and for modifications of club swings.

In the Gentilly patent, a contact area of the training device is relatively large, thus, it would be difficult to use this device for indicating to a golfer when his head and shoulder are in a particular relative position since anyone of a large number of positions would activate the device. Thus, it is another object of this invention to provide a sport club-swing marker assembly which, although it allows a sportsman to place it in a large variety of places, is relatively small so as to allows a golfer to finely tune the body positions of his swing.

SUMMARY

According to principles of this invention, a marker assembly includes a flat base member permanently attached to a front area of a sports shirt, such as a golf shirt, to cover a relatively large area approximately where a sportsman's chin, if he keeps his face directed at a ball during his backswing or forward swing, could possibly contact the shirt. The flat base member has fastening elements positioned substantially throughout the relatively large area. The assembly also includes a marker member having second releasable fastening elements which are releasably engagable with the first fastening elements at any location on the flat base member. The marker member is relatively small compared to the flat base member and includes an indicating portion which communicates to the golfer (or other sportsman) that his head and other body members are in proper positions during a club swing.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is an isometric view of a golfer shown during a backswing who is wearing a marker assembly of this invention;

FIG. 2 is a front view of a shirt having a marker assembly of this invention mounted thereon; and, FIG. 3 is a cross-sectional view taken on line 3—3 in FIG. 2.

DESCRIPTION OF THE PREFERRED EMBODIMENT

With reference to the drawings, a golfer 10 is wearing a golf shirt 12 having a club-swing marker assembly 14 of this invention mounted in a front left shoulder portion thereof. FIG. 2 depicts the front left shoulder portion 16 of the shirt 10 in more detail whereon it can be seen that the golf-swing marker assembly 14 comprises a relatively-large flat base member 18 and a marker member 20.

The relatively large flat base member 18 is rectangular in shape and, is about 1½ inches long and ¾ of an inch wide although many other sizes and shapes of the base member 18 could be used. In the depicted embodiment, this member is located approximately 2 inches from a shoulder seam 22 and about ⅜ of an inch from an arm seam 24, however, the most important feature of its location is that it covers an area of the shirt 12 which could be contacted by the face of the golfer 10 at some monitoring point in his swing. As can be seen in FIG. 2, the flat base member 18 is positioned approximately parallel to the shoulder seam 22. An edge view of the flat base member 18 can be seen in FIG. 3 wherein it is shown sewn to shirt material 26. The flat base member 18 is basically a loop-type fastening member of a hook-loop fastening pair. That is, it is composed of a cloth-type backing 28 having loops 30 extending upwardly therefrom. There are a number of hook-loop fasteners on the market, the best known of which is VELCRO®. The cloth-type backing 28 is sewn, or otherwise permanently affixed to the shirt material 26.

The marker member 20 is comprised of an attachment hook fastening member 30 and an indicator hook fastening member 32 whose webs 30' and 32' are adhered back-to-back onto the other by an adhesive 34. In this respect, the indicator hook-fastening member 32 is wider than the attachment hook-fastening member 30, however, it is humped, or ridged, to provide an indicating ridge 36 so that the edges of the indicator hook-fastening member 32 are coincident to the edges of the attachment hook-fastening member 30. Thus, extending downwardly (as viewed in FIG. 3) from a cloth-backing 38 are attachment hooks 40 which when compressed against the attachment loops 29 of the base member 18, remain engaged therewith until a substantial amount of force is exercised to pull these members apart. Also, rising upwardly (as viewed in FIG. 3) from the attachment hook-fastening member 30 is the indicating ridge 36 having indicator hooks 42 extending upwardly from the web 32'. Of course, the indicating hooks 42 are in fact the same as attachment hooks 40, in structure, however, they have different purposes as will be explained below.

It can be seen in FIG. 2 that the marker member 20 is slightly longer than the large flat base member 18 is wide and that it is only about ⅓ as wide as the base member 18 is long. In this respect, these two members are normally placed so that their longitudinal axes cross one another as shown in FIG. 2.

In operation, one permanently attaches the relatively-large flat base member 18 to the front shoulder portion of a shirt as is described above. This could be done by an individual who purchases the shirt and the club-swing marker assembly of this invention, or it could be done by a shirt manufacturer. A user then takes a swing with a club, such as a golf club, and notices approximately where his chin, or other facial area, strikes the base portion. The purchaser then attaches the marker member 20 to the base member 18 at this approximate location so that the marker member will contact the user's chin or face area during the swing. In this respect, the user can then take another practice swing and adjust the marker as he sees fit. He can even place the marker in a desired location so as to try to achieve a certain body position during a swing with a golf, or other club.

Of course it is desirable to color-coordinate the club-swing marker assembly of this invention with the shirt 12 so that the marker assembly will not be conspicuous. It will be appreciated by those skilled in the art that the marker member 20 can be removed when it is not needed, leaving only the base member 18 which is not very noticeable.

The indicating hooks 42 extend outwardly, individually, and, without breaking the skin, prickle the user's face so that, in response to contact between the user's face and the indicator hook 42, the user realizes that his body is in a proper attitude.

It will be appreciated by those skilled in the art that the sport club-swing marker assembly described herein provides an effective feedback of a sportsman's body position during a swing without making him conspicuous or peculiar looking. Further, the marker assembly of this invention is uncomplicated in use and relatively inexpensive to construct. The fact that the marker member can be moved from place-to-place on a golfer's shirt also makes the assembly more effective in that the marker member can be small so as to contact the sportsman's face in just the right location to achieve a body position desired by the sportsman.

While the invention has been particularly shown and described with reference to a preferred embodiment, it will be understood by those skilled in the art that various changes in form and detail may be made therein without departing from the spirit and scope of the invention. For example, the relatively-large flat base member 18 could be much greater in size so as to provide additional locations at which the marker member can be selectively located. Further, the marker member 20 could be of a completely different type from that shown in the drawings. For example, it could be a noise maker or some other indicator which responds to contact between it and the face of a golfer by providing an indicating sound or light signal to the golfer. Still further, the indicator assembly can be made of materials other than VELCRO. For example, it could be made of a material sold under the trademark "Hevagrip" sold by Hevatex USA of Newtown, Pa. Further, the marker assembly can be used on both the left shoulder for back swings and the right shoulder for forward swings (for a right-handed person).

The embodiment of the invention in which an exclusive property or privilege are claimed are defined as follows:

1. A sport club-swing marker assembly comprising:

a shirt-type garment having a neck opening and arm openings to be worn on the upper body of a sportsman who will swing a club;

a flat base member having a first side thereof affixed to a front shoulder area of said shirt-type garment, said flat base member covering a relatively large area of said shirt-type garment and comprising, on a second side thereof, facing away from said shirt-type garment, a first fastening means of a fastening pair, said first fastening means being located substantially throughout said relatively large area;

a marker member for repetitive-releasable, attachment to said base member, said marker member being substantially smaller than said flat base member and having a shirt side and an indicator side, said shirt side of said marker member including a second releasable fastening means of said fastening pair for repetitively engaging and disengaging said first fastening means and, when engaged therewith, for remaining engaged thereto until a substantial amount of force is used to pull these two members apart, and said marker side of said marker member including a marker element for contacting a small facial area of said sportsman at some point during a swing of a club and providing a distinctive sensation to said small facial area for indicating to the sportsman that such contact has been made so as to inform said sportsman that a correct swing position has been achieved;

whereby said sportsman can relatively easily move said marker member to various locations on said front shoulder area of said shirt-type garment on said base member to achieve a desired contact between said marker member and said sportsman's face during a club swing by said sportsman.

2. A sport club-swing marker assembly as in claim 1, wherein said first and second fastening means of said base member and said marker member form a hook-loop fastening pair, with one of said members having hooks thereon and the other having loops thereon which, when they are pressed together, engage one another so that a substantial amount of force is required to separate them.

3. A sport club-swing marker assembly as in claim 2, wherein said marker member is comprised of an attachment hook-fastening member on one side thereof and of an indicator hook-fastening member on the other side thereof, with the attaching hook-fastening member having hooks for fastening said marker member to said base member and with said indicator hook-fastening member having a ridge formed therein for contacting the face of said sportsman to provide said distinctive sensation for said sportsman to provide an indication thereof and wherein said base member is a loop-fastening member having fastening loops for engaging the hooks of said attachment hook-fastening member.

* * * * *